US007155760B2

(12) United States Patent
McAlpine

(10) Patent No.: US 7,155,760 B2
(45) Date of Patent: Jan. 2, 2007

(54) WASTE TRAP

(75) Inventor: James Kenneth McAlpine, Barrhead Glasgow (GB)

(73) Assignee: McAlpine & Company Limited (GB)

( * ) Notice: Subject to any disclaimer, the term of this patent is extended or adjusted under 35 U.S.C. 154(b) by 0 days.

(21) Appl. No.: 10/624,202

(22) Filed: Jul. 21, 2003

(65) Prior Publication Data

US 2004/0034925 A1 Feb. 26, 2004

Related U.S. Application Data

(63) Continuation-in-part of application No. 10/128,681, filed on Apr. 22, 2002, now abandoned.

(51) Int. Cl.
*E03C 1/12* (2006.01)

(52) U.S. Cl. ..... 4/679; 137/247.35

(58) Field of Classification Search ..... 4/679; 137/247.35

See application file for complete search history.

(56) References Cited

U.S. PATENT DOCUMENTS

| | | | | |
|---|---|---|---|---|
| 294,489 A | | 3/1884 | McCloskey | 4/679 |
| 340,202 A | | 4/1886 | Edwards | 137/247.35 |
| 1,751,877 A | * | 3/1930 | Nance | 4/679 |
| 1,958,712 A | * | 5/1934 | Nance | 4/679 |
| 3,651,826 A | | 3/1972 | Kojima | 4/679 |
| 4,158,897 A | | 6/1979 | Cocherel | 4/679 |
| 4,244,061 A | * | 1/1981 | Webster et al. | 4/144.1 |
| 5,039,135 A | | 8/1991 | Palmer | 4/679 |
| 2004/0177439 A1 | * | 9/2004 | Nunez | 4/679 |

FOREIGN PATENT DOCUMENTS

| | | | |
|---|---|---|---|
| GB | 856064 | 12/1960 | |
| GB | 1220 982 | 1/1971 | |
| GB | 2 070 093 | 9/1981 | 4/679 |

* cited by examiner

*Primary Examiner*—Charles E. Phillips
(74) *Attorney, Agent, or Firm*—Derek H. Maughan; Frank J. Dykas; Dykas, Shaver & Nipper, LLP

(57) ABSTRACT

A waste trap 10 for use in plumbing installations is provided, the trap comprising a unitary metal body 12 defining an interior volume, and having a tubular plastics insert 20 located in an inlet 14 of the body 12 and extending into the volume to below the height of a waste outlet 16. The insert 20 partitions the upper portion of the volume into two regions, and serves to provide a water seal between the inlet 14 and the outlet 16 when the trap is in use. The insert is non-removably secured to the body.

15 Claims, 3 Drawing Sheets

WASTE TRAP

REFERENCE TO RELATED APPLICATIONS

This application is a continuation-in-part of U.S. patent application Ser. No. 10/128,681, filed 04/22/2002, now abandoned.

FIELD OF THE INVENTION

The present invention relates to a waste trap for use in plumbing installations and the like.

BACKGROUND OF THE INVENTION

It is a requirement of environmental legislation that waste outlets from plumbing installations, such as sinks, basins, bathtubs, urinals, and the like, incorporate a waste trap between the installation and the mains outflow. Such waste traps prevent emission of noxious gases from the mains outflow, and help to provide a barrier between the plumbing installation and the mains outflow. A typical waste trap provides a water or other fluid seal within the plumbing, such that fluids may flow from the plumbing outflow, through the fluid seal, and into the mains outflow without disrupting the integrity of the fluid seal and hence the risk of emission of gases.

The traditional form of a water trap is the conventional U-bend; that is, a U-shaped section of piping which retains a water seal within the bend of the U. While this arrangement is adequate for many purposes, it does require a certain minimum amount of space for installation, which may not always be available. Further, as the importance of interior design increases, and customers become more sensitive to aesthetic appeal of products, the traditional U-bend is becoming less popular, due to its perception as unsightly. Generally U-bend traps have been installed in hidden plumbing arrangements, and so there has been little or no pressure for aesthetic appeal from the traps. However, as fashions move towards the use of more exposed plumbing, there are pressures towards the use of more compact and more aesthetically pleasing exposed waste traps.

More compact waste traps are known, which may be used in more restricted spaces than conventional U-bend traps. For example, compact injection-moulded plastics traps may be produced having an internal partition to create a water seal in use between an inlet and an outlet. Such traps are produced in two or more separate parts, a main body including the inlet, outlet, and partition, and a closure member which is subsequently sonic welded to the lower part of the body to form the complete trap; however, this method of production involves high initial costs, and is only economically viable for large production runs. These traps are known as 'bottle traps'; bottle traps may be excluded from certain markets for regulatory reasons, in that typical bottle traps may be unable to meet particular stringent relevant legislation.

U.S. Pat. No. 5,039,135 to Palmer describes an elongate drain trap including a metal insert slidably received in the body of the trap. The insert is intended to be removable from and repositionable within the trap. Further, the insert is not intended to form a water seal within the trap, but is intended to serve to conduct heat into the interior of the trap; to assist in the melting of ice plugs should the water in the trap freeze.

U.S. Pat. No. 294,489 to McCloskey describes a bottle trap formed of metal into which is received a metal inlet pipe. The inlet pipe is releasably screwed into a tubular sleeve to locate it within the trap body, and is described as being removable from the body of the device.

UK Patent Application GB 2 070 093A to Carter describes a plastics drainage trap for a shower tray, which includes a dip tube bonded to a cover, with the tube being received into a body. The cover and the tube together are upwardly removable from the body of the trap.

Many traditional plumbing products are now being produced from unusual materials for aesthetic reasons; for example, glass or marble basins and the like. These materials do not fit well visually with plastics traps. Traps are typically produced from injection-moulded plastics, but for aesthetic reasons many customers prefer to have a metallic appearance to the trap; hence the plastics trap may be plated with a thin layer of metal. Again, this increases the costs of manufacture. Further, the trap nonetheless retains the weight and feel of a plastics trap, which may deter some customers. However, plating technology now makes available a large range of different and unusual plating finishes, such as brushed, hammered, or weathered finishes of a range of different colours. Many of these finishes are not suitable for plating onto plastics products, and are thus excluded from use with conventional bottle traps.

It is among the objects of embodiments of the present invention to obviate or alleviate these and other disadvantages of known waste traps.

SUMMARY OF THE INVENTION

According to a first aspect of the present invention, there is provided a waste trap comprising a body defining an interior volume, and having an inlet and an outlet each located at a height on the body; and an insert located in the inlet and extending into and partitioning the volume to below the height of the outlet, to allow provision of a liquid seal between the inlet and outlet, wherein the insert is non-removably secured to the body.

The present invention thus allows the body of the trap to be manufactured without an insert or partition for permitting creation of the liquid seal, thereby simplifying and rendering less expensive the manufacturing process—for example, in preferred embodiments of the invention complex injection moulds are not required to produce the body, since the internal topography of the trap is created by the insert; in addition, welding is not necessary to complete the body, so improving integrity of the body. The height of the water seal produced may also be varied through the simple expedient of using inserts of different lengths. The insert may be manufactured separately, and subsequently inserted into the body to allow creation of a water seal. The insert is also non-removably secured to the body; although a separate insert provides for ease of manufacture, if the insert were subsequently removable from the trap this would allow the trap to be disassembled, the insert removed, and the trap reassembled. This is undesirable since it can lead to health and hygiene risks due to the trap failing to create a water seal in use.

Preferably the insert is secured to the inlet of the body. This has the advantage of ease of access during assembly for securing the insert to the body. This also prevents unauthorised removal of the insert and reduces the risk of tampering with the trap or of breaking the water seal and rendering the trap non-functional. The insert may be secured to the body by any suitable means, for example, glue, adhesive, welding, brazing, mechanical locking such as a snap-fit or keys, a cap, nut, or the like. The insert of the present invention is also tamper-proof in the sense that it is not possible to remove the insert from the body once assembled and secured without damaging the insert or the body. This ensures that accidental installation of the trap without the insert is not possible.

Preferably the body is a unitary body; that is, produced in one piece.

Preferably the body is formed of metal; conveniently brass or steel may be used. The body may be plated with a desired metal and finished appropriately; for example, a mirrored chrome plate. The provision of a metal body facilitates plating, and also assists production of a substantially smooth and seamless body. Preferably the body is produced by casting, most preferably die-casting. The separate nature of the body and the insert of the present invention allows a metal casting process to be used for manufacture. This is not only simple and relatively inexpensive when compared to injection moulding of plastics, but also allows for the manufacture of all-metal traps which have an aesthetically favourable appearance and feel. Furthermore, the relatively low costs involved in tooling up to produce a particular body facilitate small production runs, allowing body designs to change to take account of changing tastes, and the production of custom-made or low-volume body designs for specific customers. For example, a unique trap body design may be produced exclusively for fitting in a new building complex.

Preferably the insert is tubular, and more preferably cylindrical. While it may be possible for the insert to form a reliable seal by interaction of the insert with an inner wall of the body, it is preferred that the insert itself is tubular.

Preferably the insert is of plastics material; although metal or other suitable materials may be used if preferred. It is preferred that the insert is of a design which may be utilised in a variety of body forms or designs.

Preferably the insert and body are manufactured separately, and the insert is subsequently inserted into the body.

Preferably the height of the inlet in the body is above the height of the outlet.

Preferably the body defines a top and a side, and the inlet is located in the top of the body and the outlet is located in the side of the body.

Preferably the body further comprises fittings for attaching the trap to other plumbing components. For example, screw threads may be provided on the outlet and inlet. Where the insert is secured to the body by means of a nut or the like, a screw thread may be provided on an exterior surface of the nut.

The trap may further comprise a second insert lining an internal surface of the outlet. This allows provision of a smooth internal bore of the outlet without the need for precision machining or manufacturing of the outlet bore itself.

According to a second aspect of the present invention, there is provided a method of manufacturing a waste trap, the method comprising the steps of:

providing a body defining an interior volume, and having an inlet and an outlet each located at a height on the body;

locating an insert in the inlet extending into the volume to below the height of the outlet; and non-removably securing the insert to the body.

The step of providing the body may comprise the step of producing a unitary body. The body may be produced by casting metal.

According to a further aspect of the present invention, there is provided a waste trap comprising a body defining an interior volume, and having an inlet and an outlet each located at a height on the body; and an insert located in the inlet and extending into and partitioning the volume to below the height of the outlet, wherein the trap contains a volume of liquid to provide a liquid seal between the inlet and outlet, said insert being non-removably secured to the body.

BRIEF DESCRIPTION OF THE DRAWINGS

These and other aspects of the present invention will now be described by way of example only and with reference to the accompanying drawings, in which.

DETAILED DESCRIPTION OF THE DRAWINGS

Figure 1:
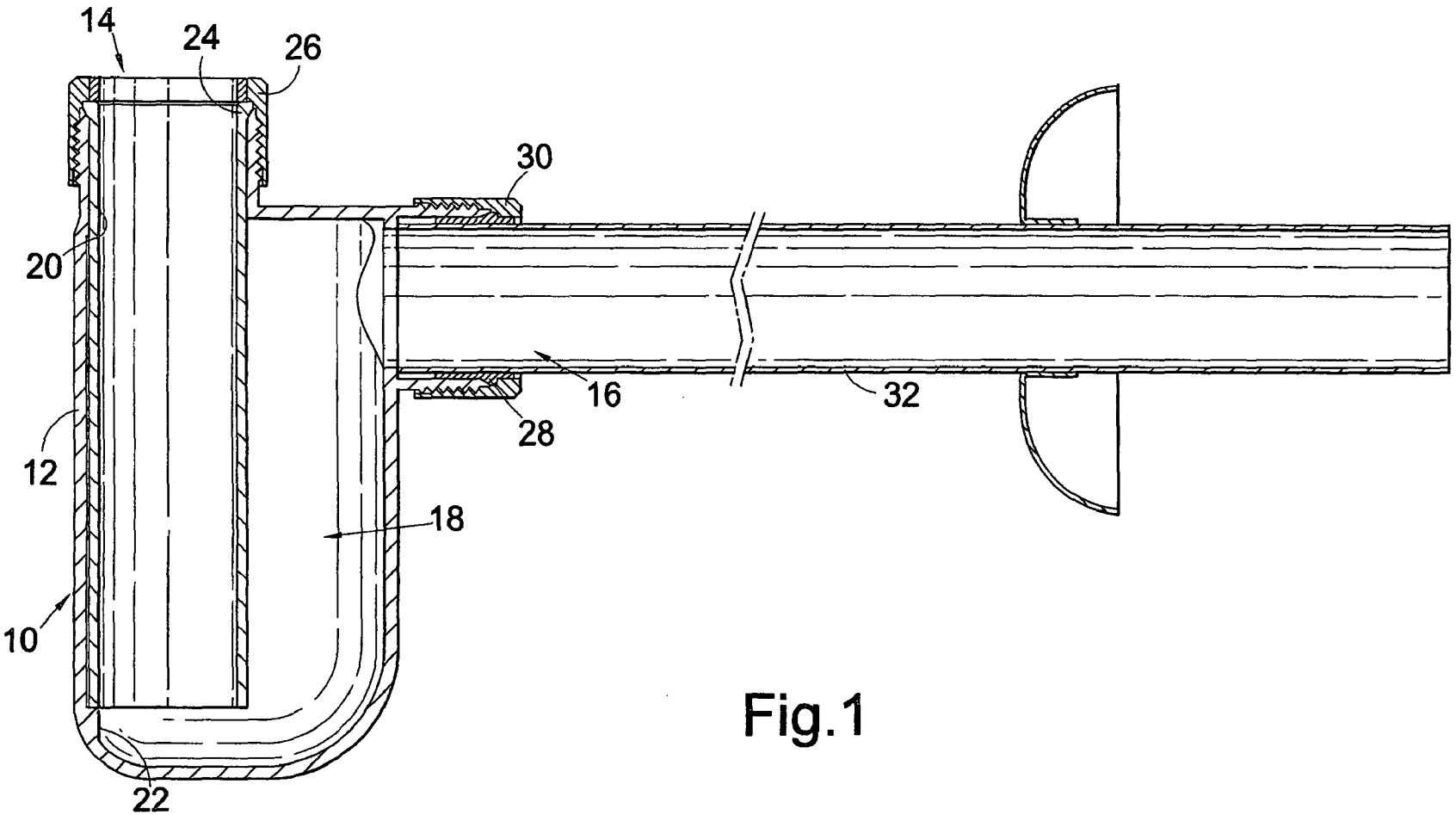
FIG. 1 is a sectional view of a trap in accordance with an embodiment of the present invention attached to a section of pipe.

Referring first of all to FIG. 1, this shows a sectional view of a waste trap, in particular a pedestal lavatory trap, in accordance with an embodiment of the present invention. The trap 10 comprises a compact, cast brass body 12 having an inlet 14 and an outlet 16, with the body 12 defining a volume 18 there between. The inlet 14 is located on the top of the body 12, with the outlet 16 being provided on the side of the body at a lower height.

Located within the body 12 and inlet 14 is a tubular plastics insert 20, which extends into the volume 18 to substantially below the height of the outlet 16. A shoulder 22 on the lower surface of the interior of the body provides a stop against which the insert 20 may rest; this allows the insert to be located at a predetermined height within the body during assembly. The top of the insert 20 carries a protruding flange 24, which rests on top of the inlet 14. The insert is non-removably secured to the inlet by means of adhesive; this prevents the insert from being subsequently removed. A securing nut 26 is fastened to the body 12 by means of co-operating screw threads on the inlet and nut, and abuts the upper surface of the inlet flange 24 thereby serving to further secure the inlet 20 within the body 12. The nut 26 may be made non-removable to further ensure that the insert is non-removably secured to the body. Alternatively, the insert may be non-removably secured to the body by welding, brazing, mechanical locking, snap-fitting, and the like. This list is not exhaustive, and further securing methods may of course be used.

The outlet 16 of the body 12 also carries therein a second plastics insert 28, although this insert 28 does not extend into the volume 18 defined by the body. The insert 28 is also secured to the outlet 16 by means of a securing nut 30. The second insert 28 provides a smooth inner face to facilitate secure and fluid-tight fitting of a section of pipe 32 or the like into the trap 10 in use.

Figure 2:
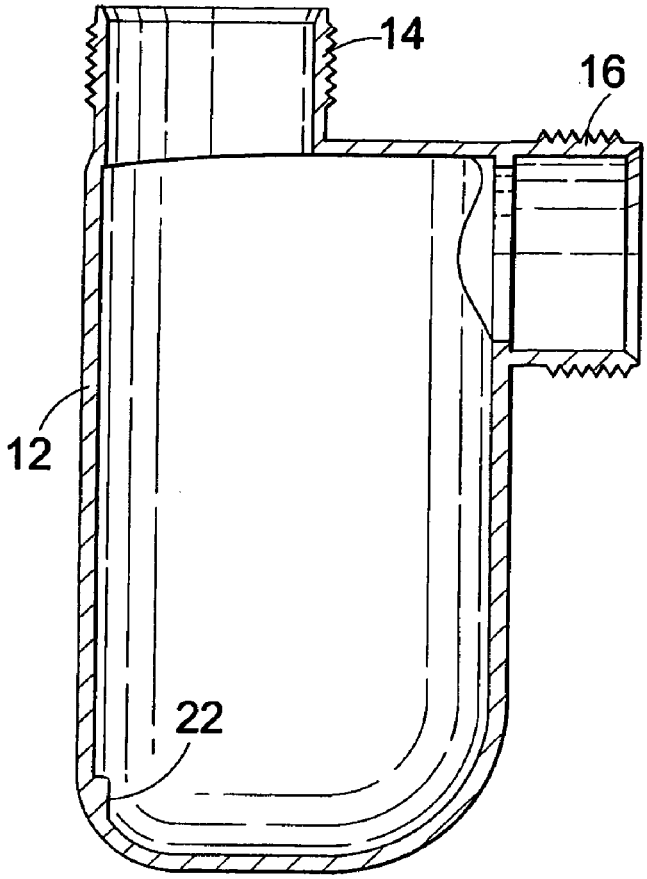
FIG. 2 is a sectional view of the body of the trap of FIG. 1.

FIG. 2 illustrates a sectional view of the body 12 of the trap of FIG. 1, showing the threaded inlet 14 and outlet 16. The body 12 is cast in a single unit from brass, which is then polished and plated to provide a smooth and seamless appearance. The plastics insert 20 is simply inserted into the inlet 14 and pushed into the volume 18 until the lower end of the insert abuts the stop 22. The securing nut 26 may then be fastened to the inlet 14 to securely retain the insert 20 therein; alternative or additional securing means as described above may be used.

Figure 3:
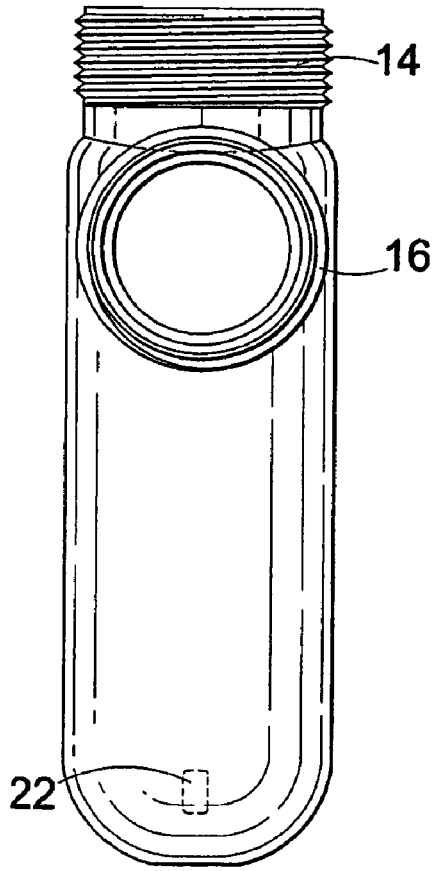
FIG. 3 is a side view of the trap body of FIG. 2.
Figure 4:
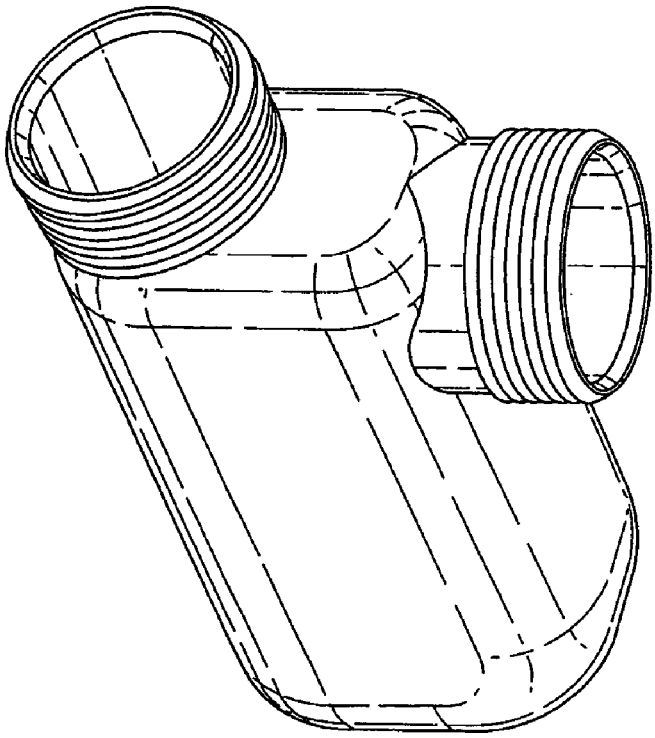
FIGS. 4 and 5 are perspective views of the trap of FIG. 1.
Figure 5:
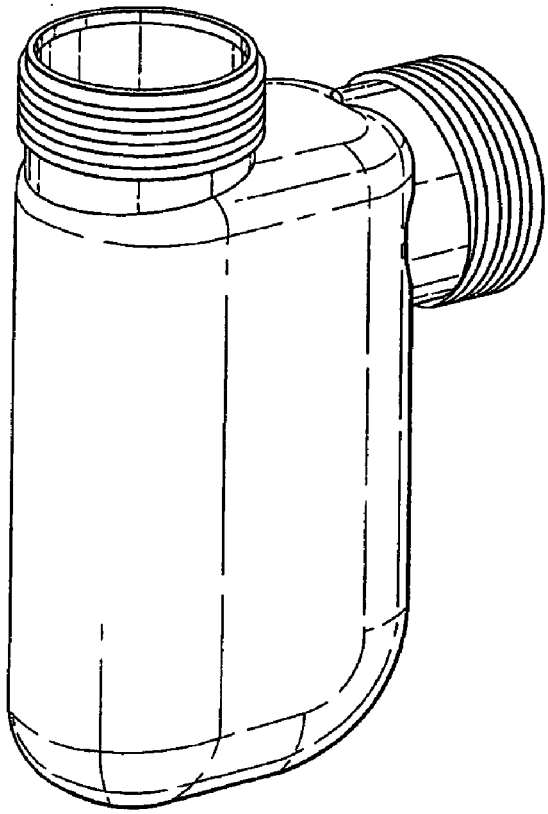

Side and perspective views of the trap 10 are shown in FIGS. 3, 4, and 5, which serve to illustrate the compact nature of the trap.

When in use, the trap 10 retains a column of water or other liquid within the volume 18 defined by the trap body 12. This column of water extends into the tubular insert 20 as well as that part of the volume outside the insert. Thus, the water column may act as a water seal to prevent backflow of fluids and gases through the trap 10.

The manufacture of the trap 10 is simplified by the integral nature of the body, and the ease of assembly of the body and insert. Further, the possibility of casting the body from metal allows for all-metal traps to be produced if desired.

I claim:

1. A waste trap comprising a body defining an interior volume, and having an inlet and an outlet each located at a height on the body; and an insert located in the inlet and extending into and partitioning the volume to below the height of the outlet, to allow provision of a liquid seal between the inlet and outlet, the body being made of metal and the insert being of plastic, wherein the insert is non-removably secured to the body prior to use such that it is not possible to remove the insert from the body without damaging the insert or the body.

2. A waste trap according to claim 1, wherein the body is a unitary body.

3. A waste trap according to claim 1, wherein the body is produced by casting.

4. A waste trap according to claim 1, wherein the insert is tubular.

5. A waste trap according to claim 1, wherein the insert is cylindrical.

6. A waste trap according to claim 1, wherein the insert is of plastics material.

7. A waste trap according to claim 1, wherein the insert is of a design which may be utilized in a variety of body forms or designs.

8. A waste trap according to claim 1, wherein the insert is secured to the inlet of the body.

9. A waste trap according to claim 1, wherein the insert and body are manufactured separately, and the insert is subsequently inserted into the body.

10. A waste trap according to claim 1, wherein the height of the inlet in the body is above the height of the outlet.

11. A waste trap according to claim 1, wherein the body defines a top and a side, and the inlet is located in the top of the body and the outlet is located in the side of the body.

12. A waste trap according to claim 1, wherein the body further comprises fittings for attaching the trap to other plumbing components.

13. A waste trap according to claim 1, further comprising a second insert lining an internal surface of the outlet.

14. The trap of claim 1 wherein the insert has an upper end and the inlet has an upper end, and the upper end of the insert is located below the upper end of the inlet.

15. A waste trap according to claim 1, wherein the inlet and the outlet are each adapted to be connected to a respective pipe.

* * * * *